US005152307A

United States Patent [19]

Schlaszus

[11] Patent Number: 5,152,307

[45] Date of Patent: Oct. 6, 1992

[54] TRAVEL KIT

[75] Inventor: Hans-Joachim Schlaszus, Achim, Fed. Rep. of Germany

[73] Assignee: Bernd C.W. Muller, Bremen, Fed. Rep. of Germany

[21] Appl. No.: 723,699

[22] Filed: Jun. 25, 1991

Related U.S. Application Data

[63] Continuation of Ser. No. 426,317, Oct. 23, 1989, abandoned.

[30] Foreign Application Priority Data

Oct. 22, 1988 [DE] Fed. Rep. of Germany ... 8813333[U]

[51] Int. Cl.[5] ..... A45D 40/24

[52] U.S. Cl. ..... 132/314; 132/289; 132/308; 132/313; 206/581; 206/823

[58] Field of Search ..... 132/73.5, 76.4, 148, 132/286, 287, 289, 290, 294, 295, 298, 300, 308, 309, 311, 313, 314, 315, 317; 206/38, 228, 229, 235, 581, 823

[56] References Cited

U.S. PATENT DOCUMENTS

| | | | |
|---|---|---|---|
| 675,766 | 5/1901 | Craven | 132/313 |
| 922,592 | 5/1909 | Jensen | 132/315 |
| 1,059,537 | 4/1913 | Hanson | 132/308 |
| 1,368,735 | 2/1921 | Lang | 132/313 |
| 1,398,583 | 11/1921 | Bovee | 132/289 |
| 2,062,237 | 11/1936 | Schwartz | 132/314 |
| 2,122,158 | 6/1938 | Segal | 206/228 |
| 2,850,152 | 9/1958 | Marrufo | 206/38 |
| 3,323,638 | 6/1967 | Dishart | 132/148 |
| 3,816,007 | 6/1974 | Fox | 132/311 |
| 3,856,027 | 12/1974 | Legere | 132/313 |
| 4,056,110 | 11/1977 | Landsman | 132/311 |
| 4,344,535 | 8/1982 | Cagnazzi | 206/229 |
| 4,555,020 | 11/1985 | Campello et al. | 132/294 |
| 4,562,923 | 1/1986 | Katada et al. | 132/314 |
| 4,705,051 | 11/1987 | Bacon et al. | 132/317 |
| 4,716,915 | 1/1988 | Byrns | 132/286 |
| 4,726,387 | 2/1988 | Sarica | 132/313 |
| 4,768,530 | 9/1988 | Vaughn | 132/289 |
| 5,007,540 | 4/1991 | Beasley et al. | 206/581 |

FOREIGN PATENT DOCUMENTS

| | | | |
|---|---|---|---|
| 0101297 | 2/1984 | European Pat. Off. . | |
| 348258 | 3/1921 | Fed. Rep. of Germany . | |
| 886520 | 8/1953 | Fed. Rep. of Germany | 132/286 |
| 2654870 | 8/1978 | Fed. Rep. of Germany . | |
| 2490084 | 3/1982 | France | 132/289 |
| 2604612 | 8/1988 | France . | |
| 661095 | 11/1951 | United Kingdom | 132/314 |

*Primary Examiner*—Gene Mancene
*Assistant Examiner*—Frank A. LaViola
*Attorney, Agent, or Firm*—Merchant & Gould Smith, Edell, Welter & Schmidt

[57] ABSTRACT

A travel size vanity case with a plurality of chambers for holding removable toilet articles or the like, which may be used advantageously in travelling. Each article is accessible at a unique location on the sidewalls of the case. At least one of said sidewalls is formed integrally with at least one the removable toilet article, creating a continuous closed outer surface. Other toilet articles are removable from at least one openable flap in the sidewall.

7 Claims, 13 Drawing Sheets

Figure 2:
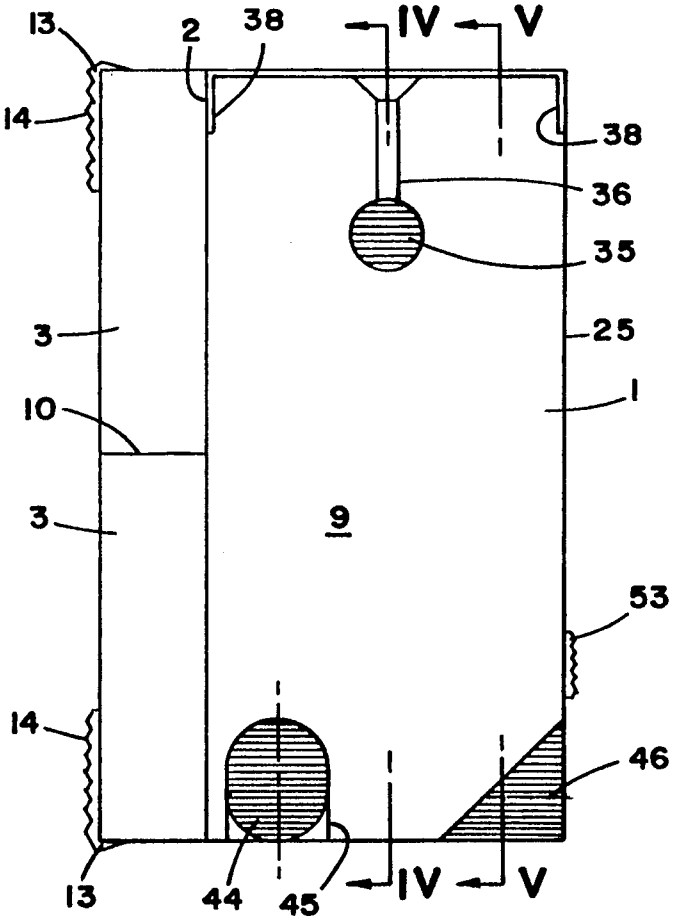

FIG. 6d
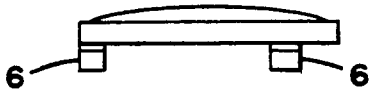
FIG. 6c
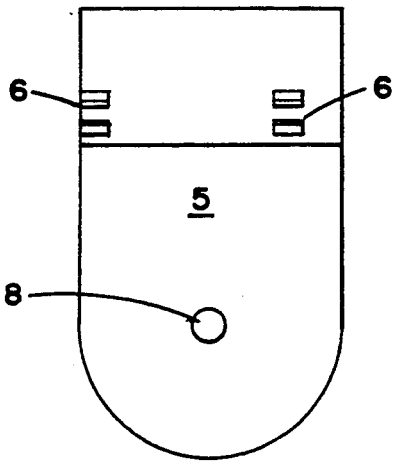
FIG. 6b
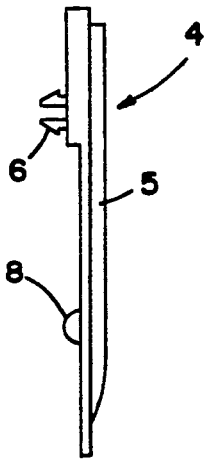
FIG. 6a
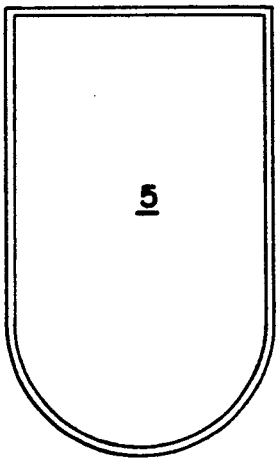
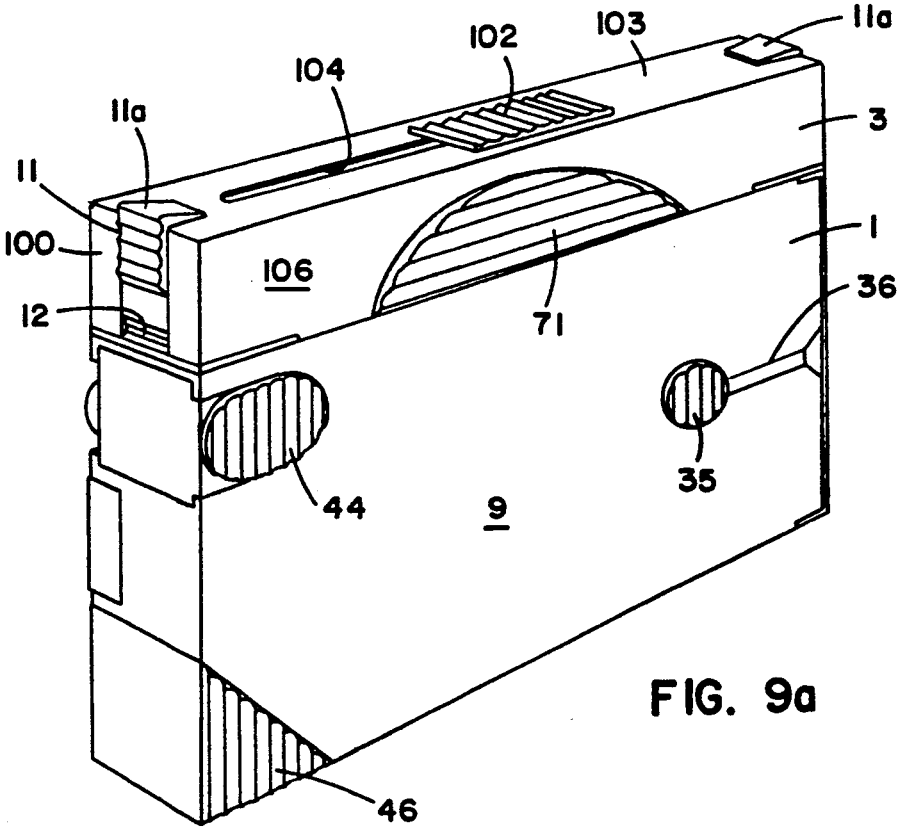
FIG. 9a FIG. 7A
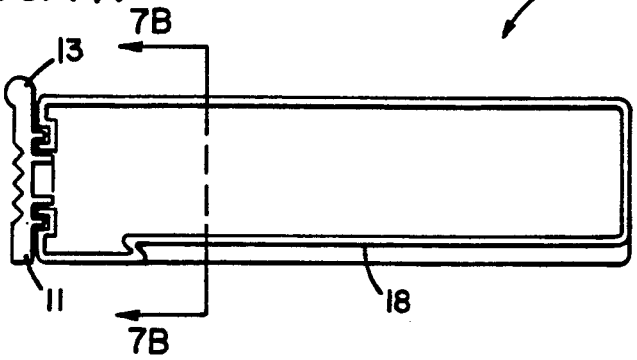
FIG. 7B
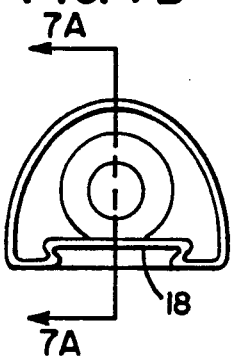
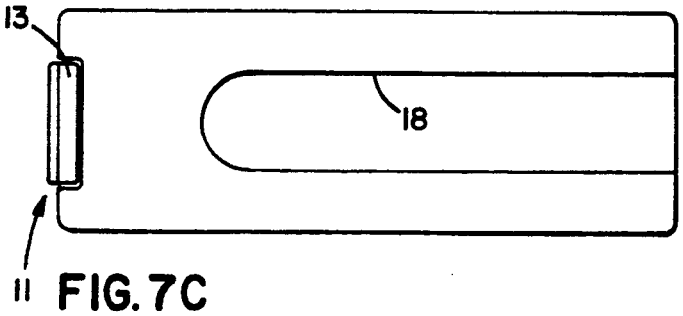
FIG. 7C
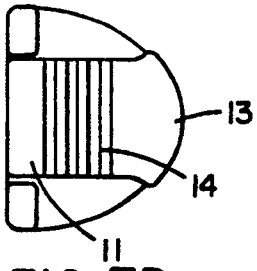
FIG. 7D
FIG. 8A
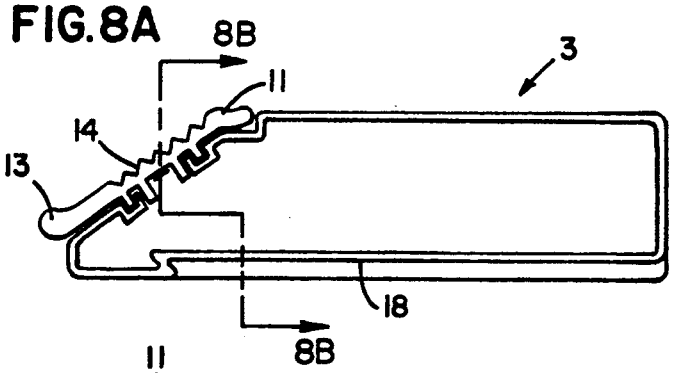
FIG. 8B
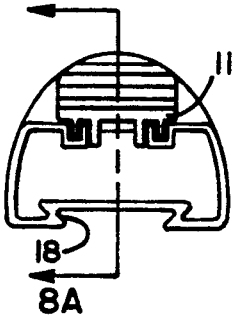
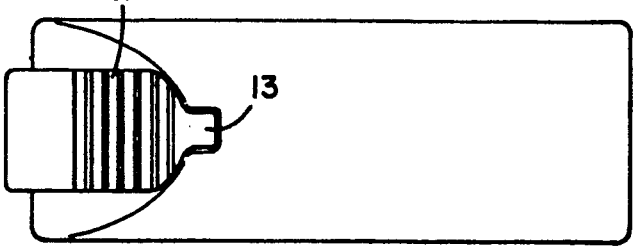
FIG. 8C

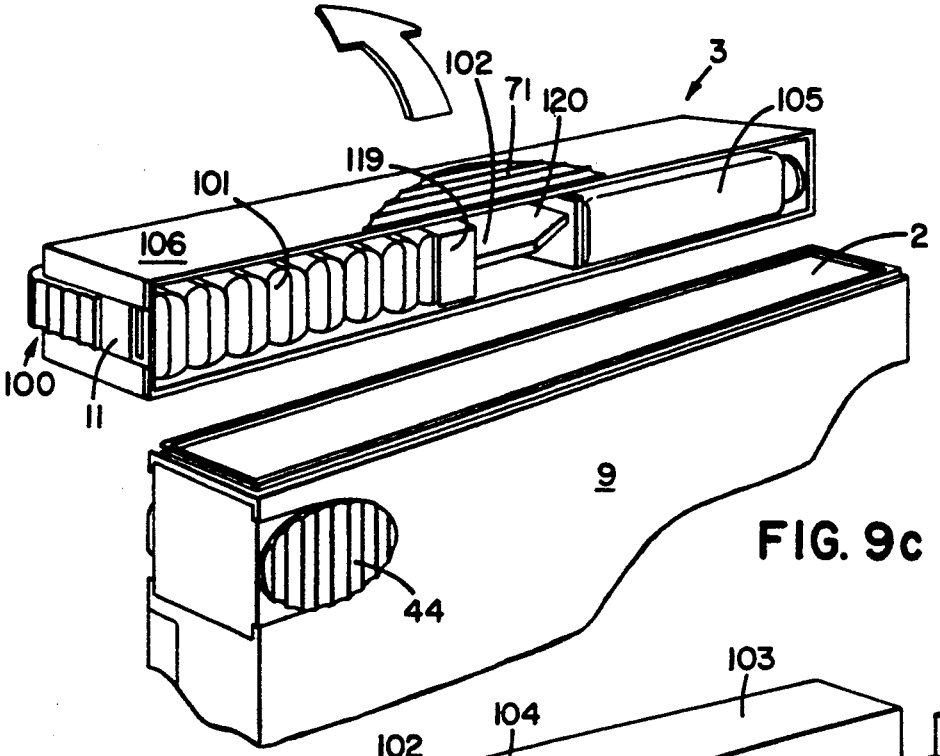
FIG. 9c
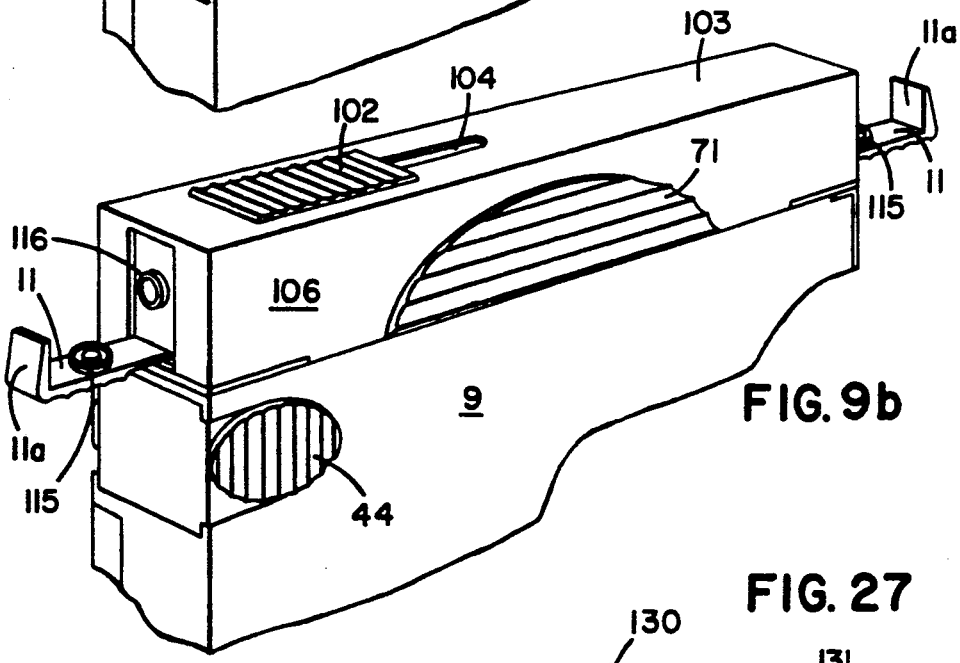
FIG. 9b
FIG. 27
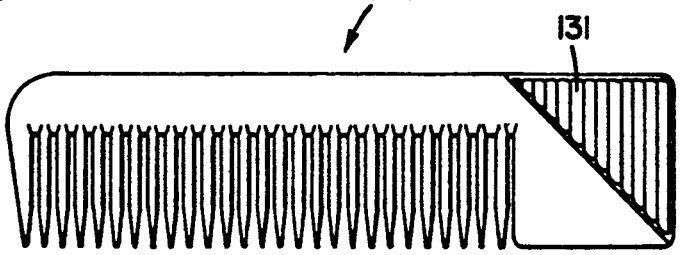

38
39
40
14b
37
41
42
43
44
31
32
33
33a
34
35

48
49
50
51
52
53
54
55
56
46
47
59
60

73a
70
73a
3

70
71
3

71
70
71
3

72
2
95(96)
82
88
83
85
72
1

TRAVEL KIT

This is a continuation of application Ser. No. 426,317, filed Oct. 23, 1989, now abandoned.

The invention is concerned with a vanity-case which in particular may advantageously be used in travelling. It may, for example, be held in readiness by air travel companies for their passengers and it enables travellers to exercise the most necessary measures of personal care without access to their own luggage.

The idea is known of making travel versions of certain appliances for personal care and the accessories necessary for that—for example, toothbrush and toothpaste—in special spacesaving forms (EP-PS 109 482). As compared with that the problem underlying the invention is within the scope of a closed unit to hold in readiness in a spacesaving manner kindly to the user, all of the articles necessary for the usual processes of personal care.

In accordance with the most general aspect of the invention this problem is solved by a number of appliances serving for personal care being combined in an essentially parallelepipedal casing after the style of a flat but lidless box and being accessible from its narrow sides. The casing may be grasped at the opposite main sides and readily held in such a way that with the other hand what is required at the time is seized at the narrow sides of the casing. A clip-on bracket may also be fastened to one of the main sides, by which the casing may be fixed temporarily to the waistband of trousers, a breast pocket or the like, so that no hands are needed for it; yet the flat casing only sticks out a little and does not bother the user and as before allows the handling of all of the individual parts accessible from the narrow sides.

Preferably the appliances are made suitable for insertion sideways into the casing and corresponding openings are provided in the narrow sides of the casing. Moreover in each case portions of the appliances may form parts of the walls of the casing and in the inserted state close off the casing. In this way the appliances may also be slid out by means of the fingers of the hand holding the casing; further, it is unnecessary to lay down the casing while using the appliances. At least one narrow side wall may exhibit devices for the snug but detachable mounting of additional fittings.

It has proved advantageous to provide different vanity-cases for certain fields of care. For example, one vanity-case may receive all of the utensils and their accessories serving for body-care, whilst another vanity-case contains fittings for the care of clothing. Preferred refinements are in each case objects of Sub-Claims.

Figure 1:
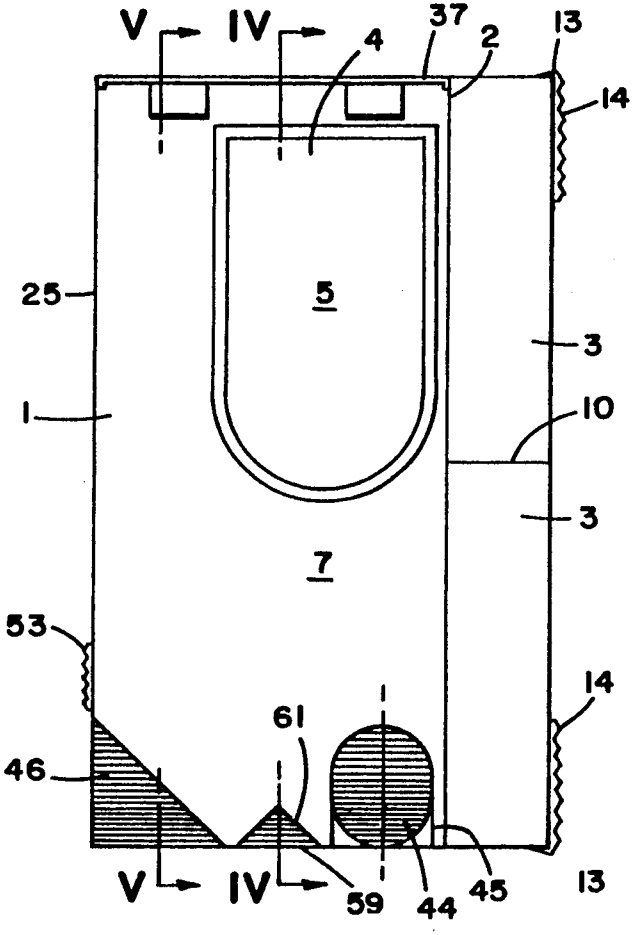
Figures 3, 4, 5:
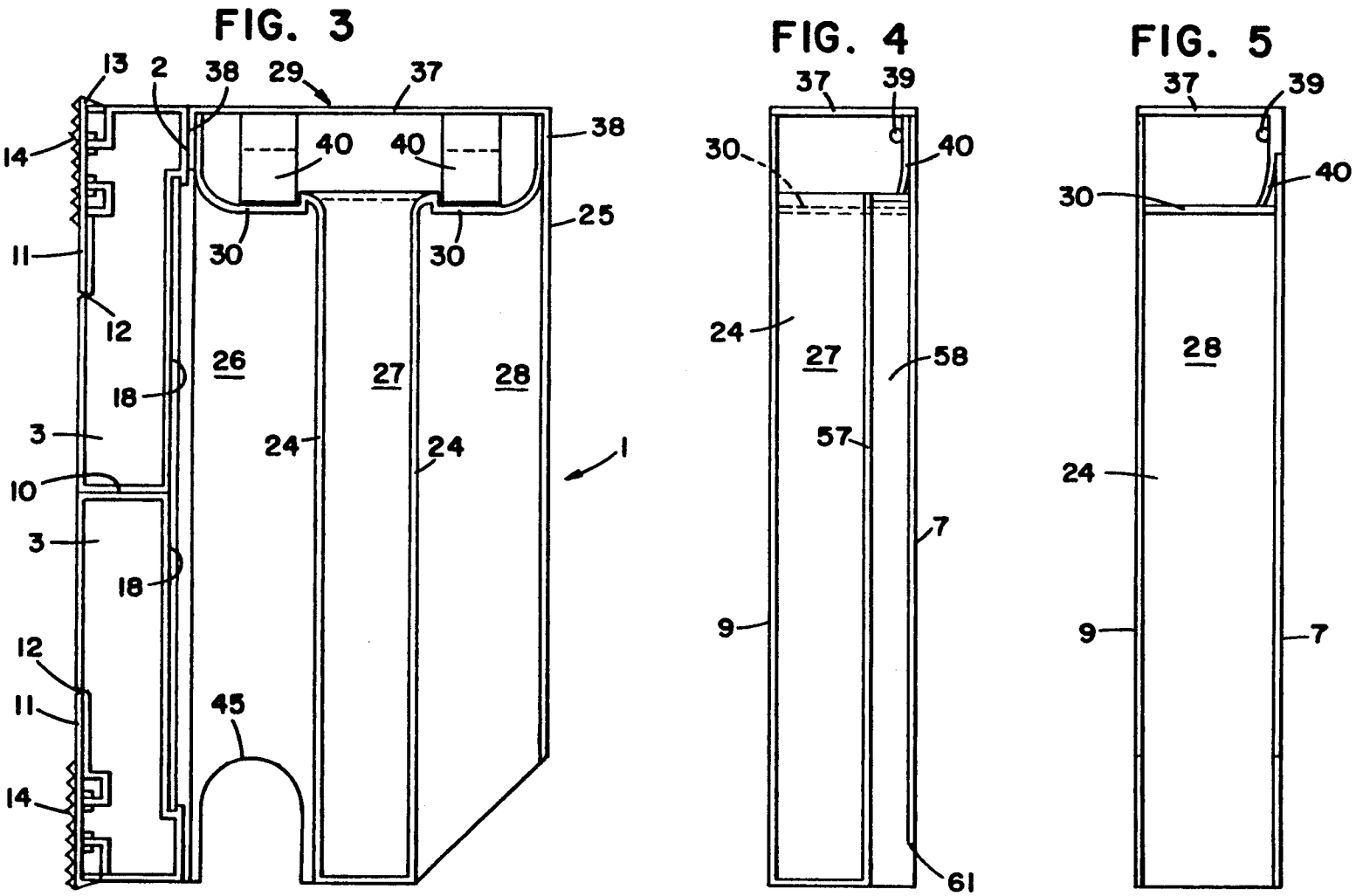
Figures 10A, 10B, 11A, 11B, 11C, 11D, 12A, 12B, 12C:
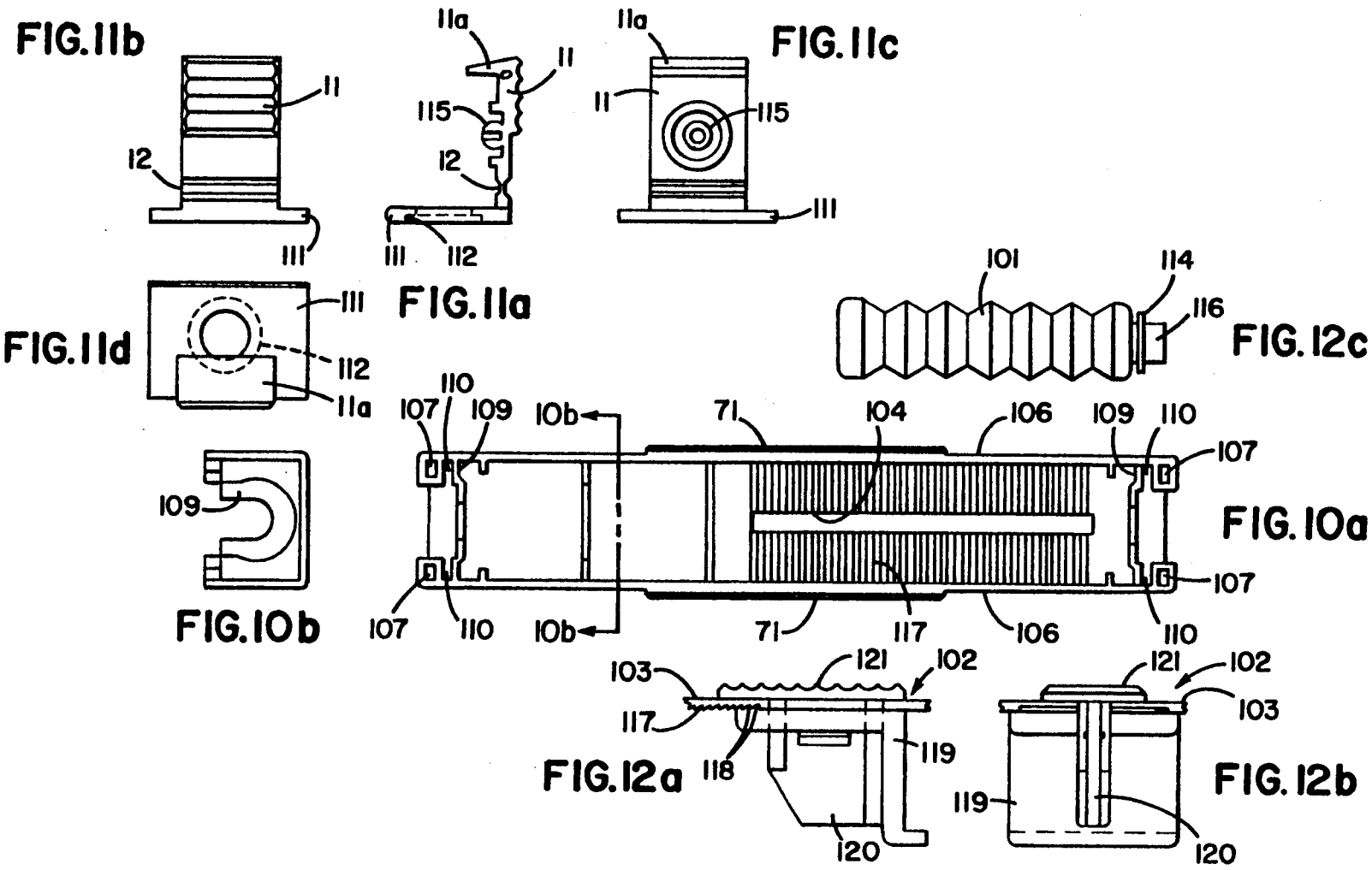
Figures 13A, 13B, 13C, 13D, 14A, 14B, 15A, 15B, 15C:
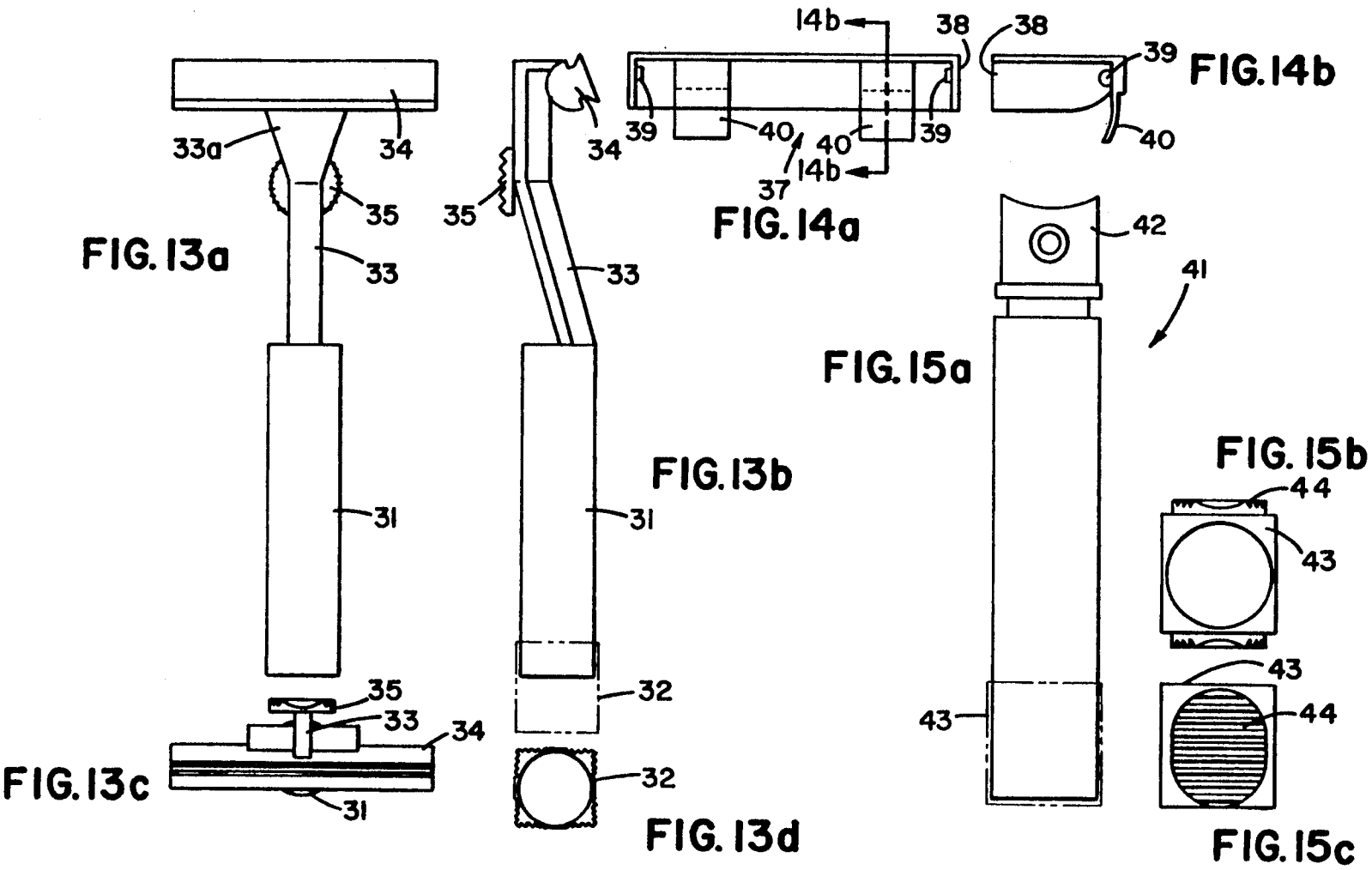
Figures 16A, 16B, 17A, 17B, 17C, 17D, 17E, 17F, 18A, 18B:
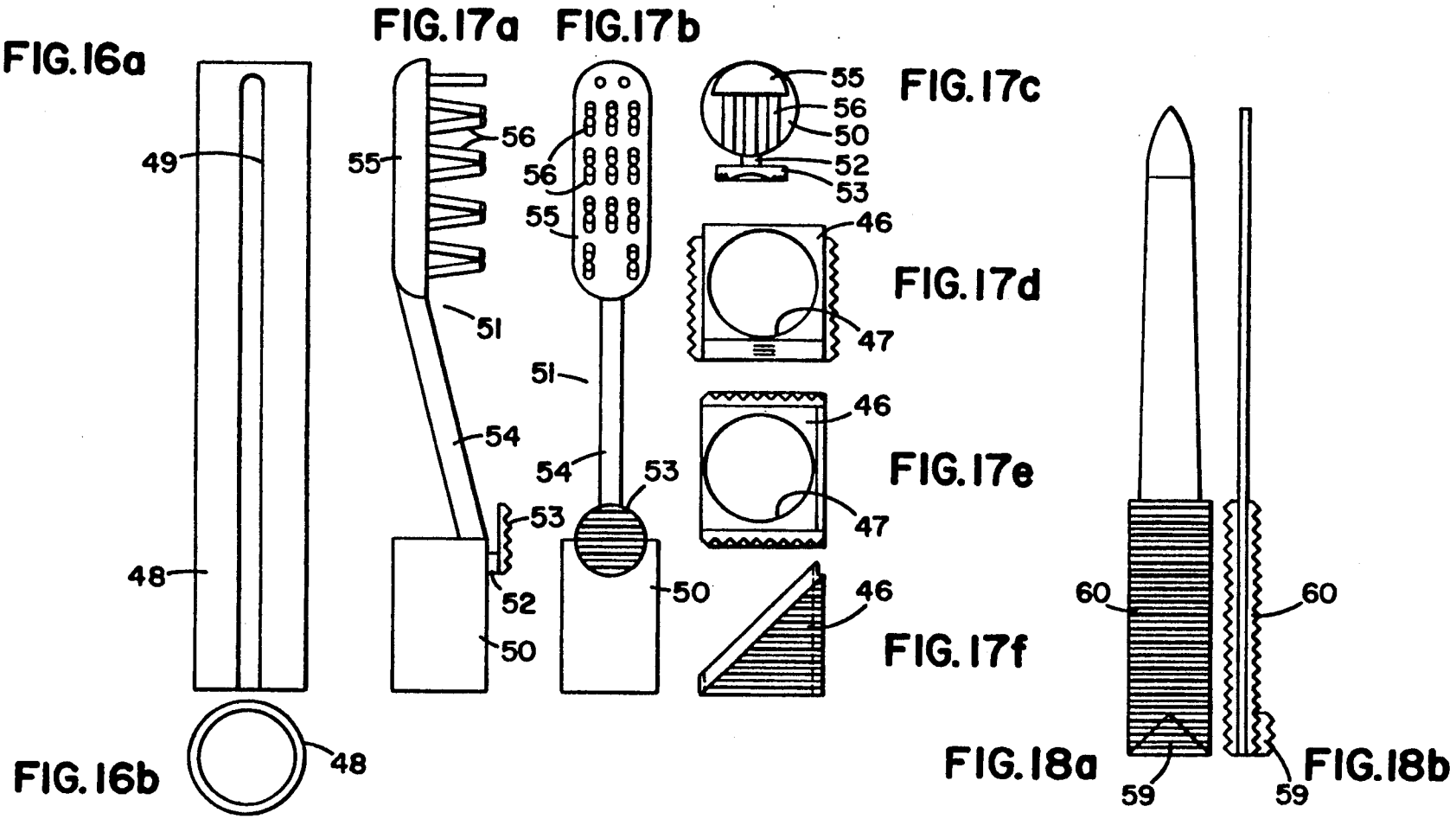
Figures 19, 20:
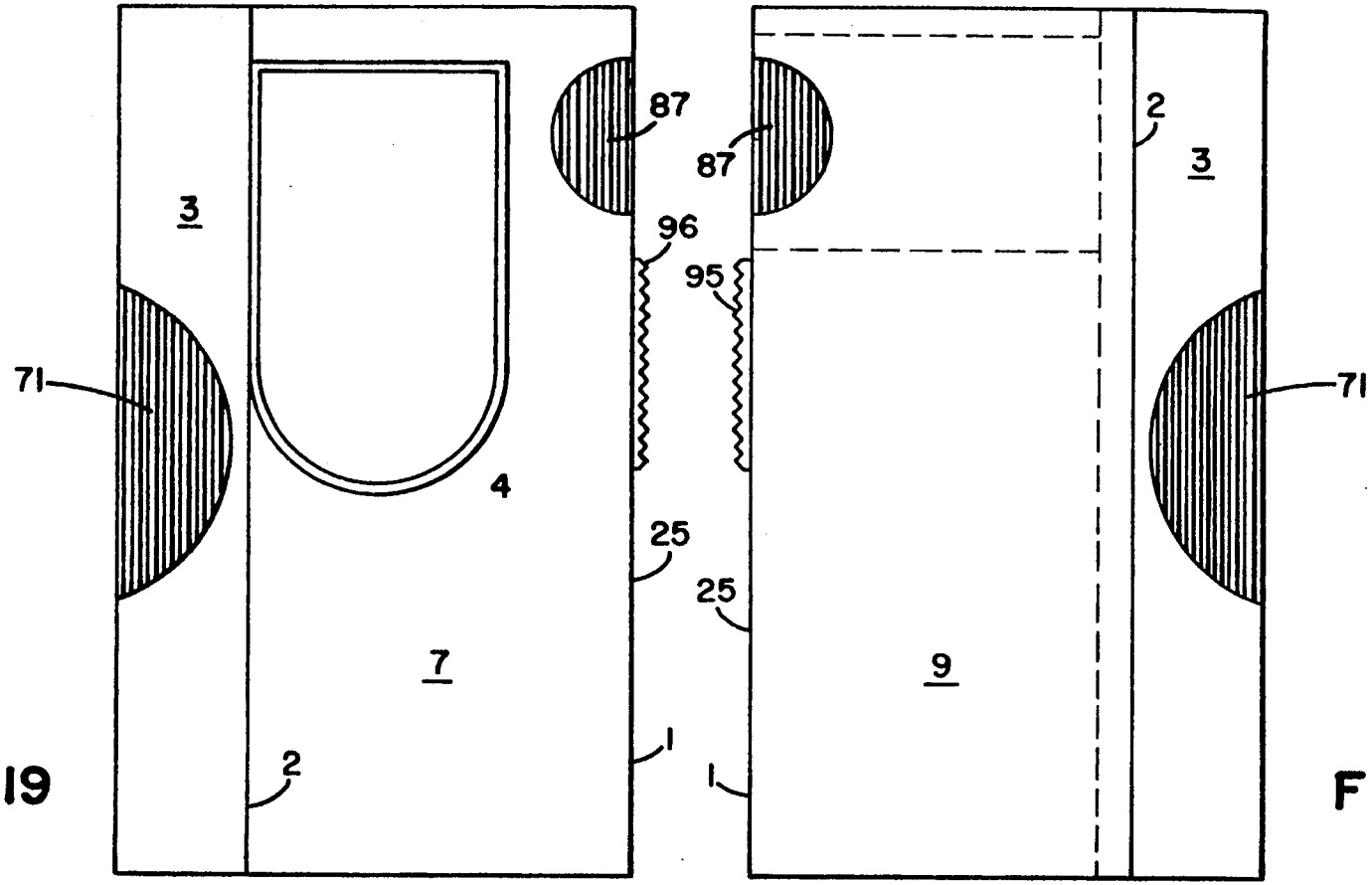
Figures 21A, 21B, 21C, 21D, 22A, 22B, 22C:
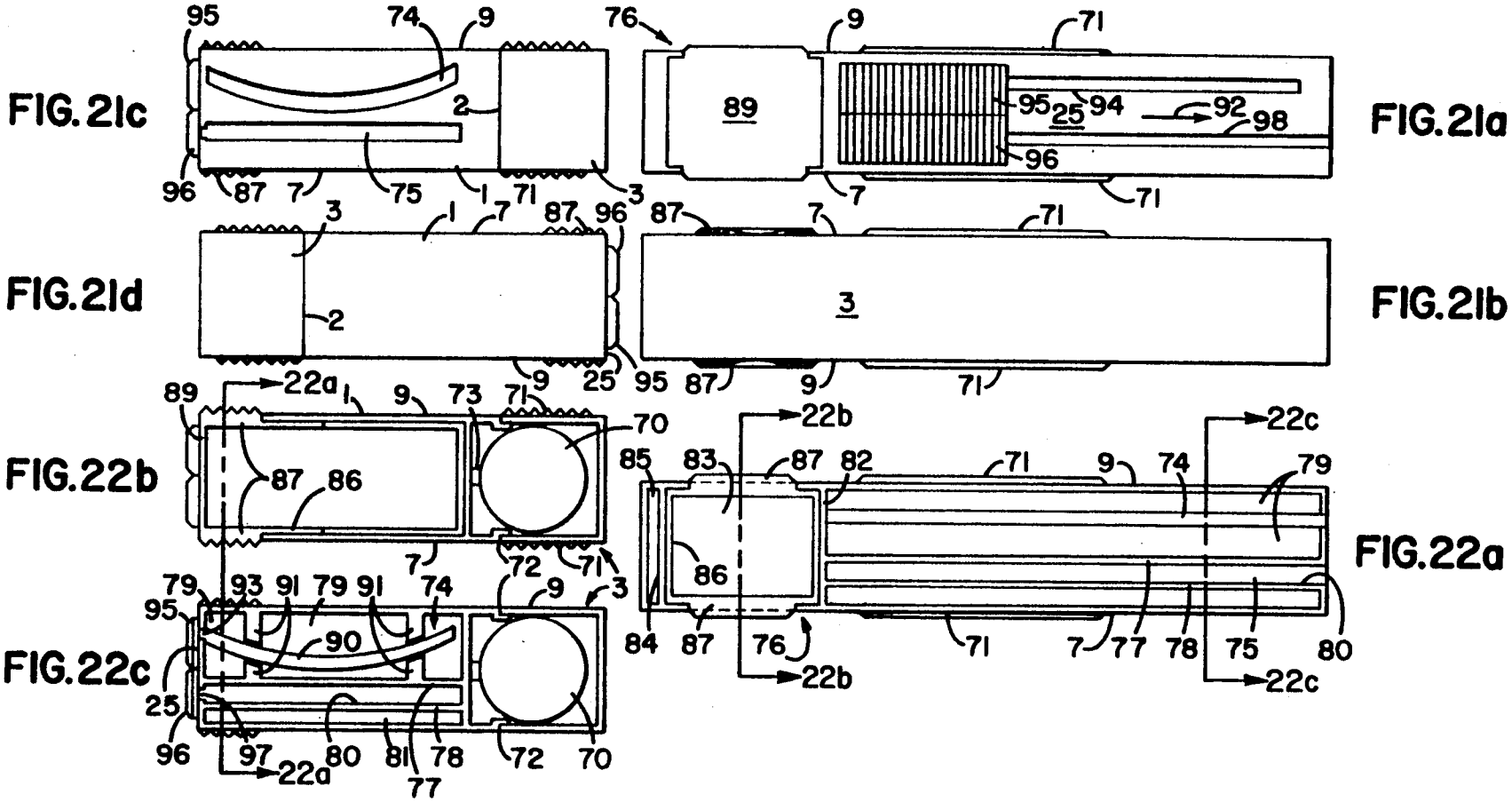
Figures 24, 25:
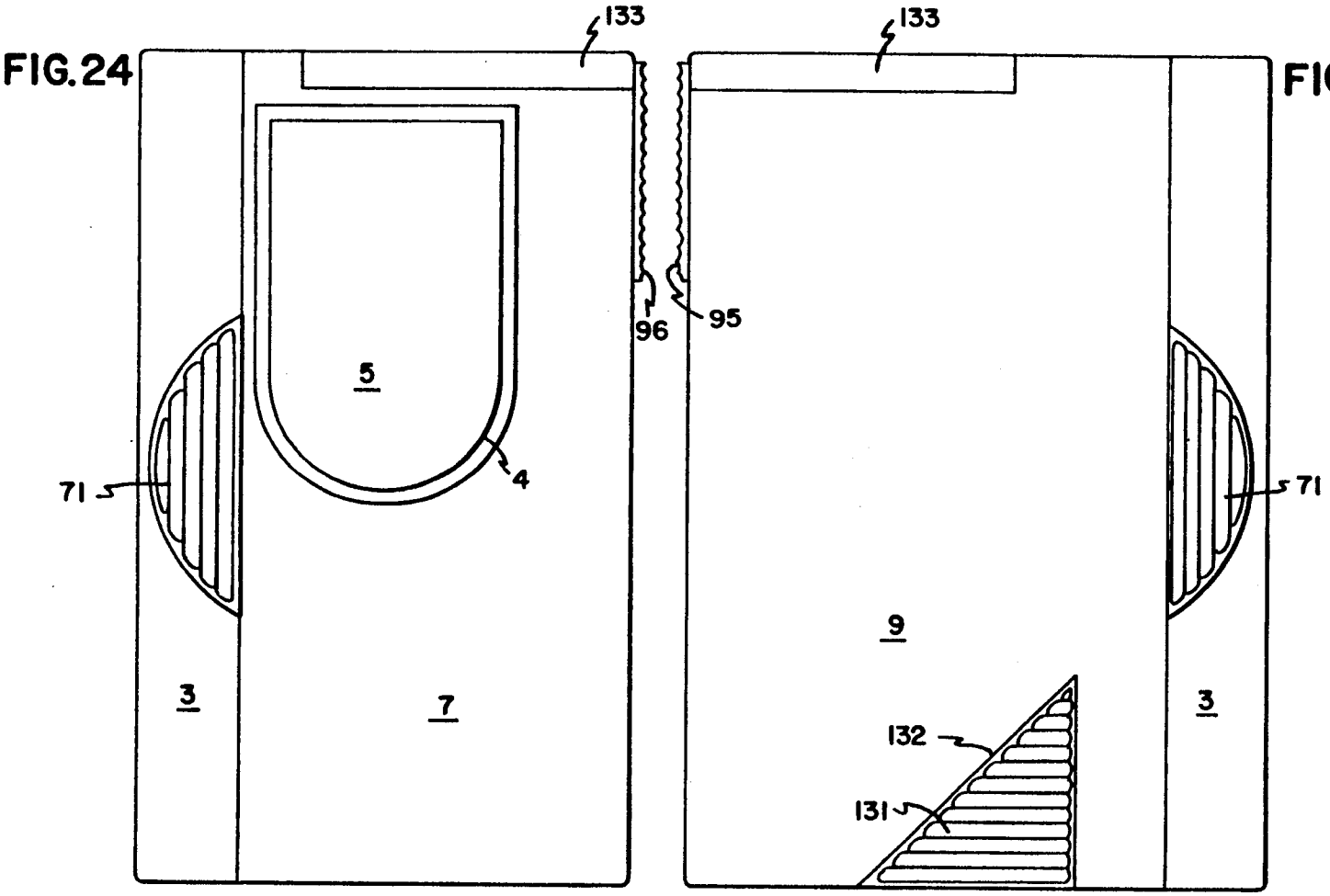

The drawings illustrate embodiments of the invention as a body-care unit and a clothing-care unit, in each case with variants of the design in detail. There is shown in:

FIG. 1—a plane of the rear main side of a complete body-care unit;

FIG. 2—a plane of the front main side of the same unit;

FIG. 3—the empty casing of the unit in longitudinal section (similar to FIG. 2);

FIG. 4—a section along the line IV—IV in FIG. 3;

FIG. 5—a section along the line V—V in FIG. 3;

FIG. 6—different views (a-d) of the detachable clip-on bracket on the rear main side of the unit in FIG. 1;

FIG. 7—different views or sections (a-d) of an alternative embodiment of the accessory fittings mounted on the side in the case of the unit as FIGS. 1-5;

FIG. 8—a modified embodiment of the fitting in accordance with FIG. 7, again in different views or sections (a-c);

FIG. 9—a perspective of the body-care unit with a further modified accessory fitting, that is, in 9*a* as a whole and 9*b,c* in part, the latter with the accessory fitting open on both sides or removed altogether;

FIG. 10—a view of the inside of the (empty) accessory fitting in accordance with FIG. 9 without the closures at the sides, that is, 10*a* towards the top wall, 10*b* towards one side wall;

FIGS. 11*a*-11*d*—one of the two closures for the accessory fitting in accordance with FIGS. 9 and 10 in section and in different views;

FIG. 12—a toothpaste tube (12*c*) and the pressure slider (12*a,b*) for the tube, guided in the accessory fitting in accordance with FIGS. 9 and 10;

FIG. 13—a razor adapted to the associated chamber in the casing of the unit, in different views (a-d);

FIGS. 14*a* and 14*b*—in side elevation and section the lid for the chamber in the casing for the razor in accordance with FIG. 13 in the case of the unit in accordance with FIGS. 1-5;

FIGS. 15*a*-15*c*—a container for shaving foam, adapted to another chamber in the casing of the unit in accordance with FIGS. 1-5, in different views;

FIGS. 16*a* and 16*b*—seen from the side and below, the tubular handle part for the brush part of a toothbrush represented in FIG. 17, adapted to yet another chamber in the body-care unit in accordance with FIGS. 1-5;

FIG. 17—the already-mentioned brush part of the toothbrush in different views (17*a-c*) as well as the base of the handle part in different views (17*d-f*);

FIGS. 18*a* and 18*b*—in plan and side elevation the nail file adapted to a further chamber in the casing of the unit;

FIG. 19—corresponding with FIG. 1, a view of a clothing-care unit;

FIG. 20—the view of the clothing-care unit corresponding with FIG. 2;

FIG. 21—the four views (21*a-d*) of the narrow sides of the unit in FIGS. 19 and 20;

FIGS. 22*a*-22*c*—a longitudinal section and cross-sections through the unit as FIGS. 19-21;

FIG. 23—an alternative embodiment of the fluff roller from the clothing-care unit in different views and sections (23*a-d*);

FIG. 24—a representation corresponding with FIG. 19 of a modified clothing-care unit;

FIG. 25—a representation of this unit corresponding with FIG. 20;

FIG. 26—sections and views of this unit; and

FIG. 27—the associated comb in side elevation.

The body-care unit represented in plane of the two main sides in FIGS. 1 and 2 has a basic casing 1 and additional fittings "saddled" along its one longer narrow side 2 in the form of two additional portions 3 of casing of the same kind but arranged in mirror image to one another. They have together the same length as the casing 1 and also its depth. The whole casing 1+3 therefore has the parallelepipedal shape of a flat box just like the basic casing 1. What is common to these components of the casing just like all of the alternative executions is that their interior is essentially if not exclusively accessible from the narrow sides.

On the rear main side 7 of the casing (FIG. 1) is fastened a clip-on bracket 4 the design of which is illustrated in FIG. 6 as an individual part, whilst its fitting to the casing appears from FIG. 26; in the representations in section in FIGS. 4 and 5 the clip-on bracket 4 is omitted. It follows from FIG. 6 that the clip-on bracket 4 exhibits a main part 5 in the form of a plate rounded on the outside, the catches 6 on which may be snapped into corresponding openings in the rear main side 7. A hemispherical button 8 on the inside of the part 5 is to improve the clamping action of the clip-on bracket 4. The clip-on bracket 4 may also be an integral component of the casing 1.

The additional fittings consists in this case of two portions 3 of casing which are themselves parallelepipedal and which terminate flush with both the rear main side 7 and the front main side 9. From top and bottom—in FIGS. 1 and 2—they are pushed by means of dovetail guides (similar to FIGS. 7 and 8) on to the casing 1 and together at 10. Liquid-tight lids which can pivot about a film hinge at 12 can be opened through outwards directed pressure against the projecting rib 13 on the ribbed portion 14 which serves for handling. The additional fittings 3 serve, for example, for receiving toothpaste and cosmetic liquid.

FIGS. 7 and 8 illustrate alternative embodiments of the additional fittings in accordance with FIGS. 1 to 3. What is different is in particular the arrangement and hinging of the lid 11 but also the outer shape which here is half-round in cross-section. Furthermore, the dovetail-shaped groove 18 is clearly recognisable, which corresponds with a corresponding elevation at the narrow side 2 of the casing 1.

In the case of the embodiment from FIGS. 9–12 the additional fittings are combined into one component in the form of a portion 3 of casing and fastened to the casing by snapping on. The interior is continuous and is provided at both end faces with closures 100 which include the lids 11 (FIG. 11). In one of the closures a bellows tube 101 (FIG. 12*c*) for toothpaste is held detachably by the neck, the contents of which may be put under pressure for squeezing out by means of a slider 102 (FIGS. 12*a*+*b*) guided in the portions 3 of casing. A slot 104 is provided for the slider 102 in the long side wall 103 of the portion 3.

Whilst FIG. 9*b* illustrates the function of the closures 100, FIG. 9*c* shows the arrangement of the bellows tube 101 and the slider 102 engaging with the free end of it, as well as the small bottle (vial) 105 for shaving lotion or the like, associated with the other closure. The bottle 105 is also held detachably by the neck. Details of the construction are shown in FIGS. 10–12, which are to be explained below.

FIG. 10*a* represents illustrated in FIGS. 1 and 2 of casing from below (that is, turned through 180° as compared with FIG. 9 so that the toothpaste tube 101 is pointing towards the right). At the end faces of the portion 3 of casing the covering wall 103 and the two side walls 106 end in hollow chambers 107 like pillars, which leave free an opening 108 between them. With a cross-wall 109 lying further in, the pillars 107 form grooves 110 into which the baseplate 111 of the closure 100 may be inserted (FIG. 11*a*).

The lid 11 of the closure 100 is hinged to the baseplate 111 by means of a film hinge 112; in the closed state it overlaps by a catch nose 11*a* the covering wall 103 of the portion 3 of casing (FIG. 9*a*).

For the insertion of a tube 101 or a small bottle 105 a recess 112 in the baseplate 111 of the closure 100 as well as a recess 113 in the cross-wall 109 of the portion 3 of casing co-operate. They take the collar 114 on the neck of the tube 101 or bottle 105 between them and lock it between them; in FIG. 19 this arrangement is omitted for simpler illustration. In the closed state the plug 115 arranged on the inside of the lid 11 becomes pressed against the opening in the nozzle 116 of the tube 101 (or the bottle 105).

The construction of the closure at the other end face of the portion 3 of casing is in principle the same. But here—where the toothpaste tube 101 is accommodated—a cross-ribbing or set of teeth 117 is formed beside the slot 114, which co-operates with teeth 118 running in parallel on the contact part 119 of the slider 102. This contact part 119 is locked by a web 120 passing through the slot 104, to the handle 121 accessible from outside; FIGS. 12*a* and *b* show this on a slightly larger scale in side and rear elevation.

Reverting to FIGS. 1 to 5: The section in accordance with FIG. 3 shows that the casing 1 is sub-divided inside into parallel chambers 26, 27 and 28 by longitudinal walls 24 which run in parallel with the longer narrow sides 2, 25. The partitions 24 nevertheless do not continue over the whole length of the casing 1 but at some distance from the short narrow side wall 29 of the casing 1 continue into walls 30 running across, so that the central chamber 27 has a T-shaped outline with the crossbar of the T extending in the region of the short narrow side 29 of the casing 1 across its whole width.

The razor represented in FIGS. 13*a*–13*d* may be inserted in the chamber 27. It consists of a (tubular) handle portion 31, a base 32, a cranked stem 33 and fitted at the free end of this, the blade holder 34 running across. A ribbed sliding grip-plate 35 is fastened to the stem 33 and projects through the slot 36 in the front main side 9 of the casing 1 and rests against the outside of the main side 9 (FIG. 2). The face 33*a* of the stem 33 rests against the inner face of the main side 9, and through sliding pressure against the grip-plate 35—upwards in FIG. 2—the razor may be pushed out of the chamber 27.

In the region of the short narrow side 29 the chamber 27 is closed off by the lid flap 37 represented separately in FIG. 14*a*–14*b*. The flanges 38 at the side of it also form part of the wall of the longer narrow sides 2 and 25. By means of studs 39 they are supported pivotally in the walls 30 drawn round them in accordance with FIG. 3. On the inside extensions 40 are provided on the swinging flap 37, which have the shape recognisable in cross-section in FIG. 14*b* and serve to pull the swinging flap 37 into its closed position (FIG. 3) when after use the razor is returned into the chamber 27 again.

Into the chamber 26 may be inserted a dispenser 41 containing shaving foam (or the like) as illustrated in FIGS. 15*a*–15*c* which by axial pressure against its head 42 releases the material contained. At the other end a base 43 square in cross-section is pushed over the round cross-section of the appliance 41. The outer cross-section of the base 43 corresponds with the cross-section of the chamber 26 but on opposite sides of the base 43 grip-portions 44 are mounted which correspond with cutouts 45 lying opposite one another in the main sides 7 and 9 of the casing 1; FIGS. 1 and 2 show the inserted state. The oval profile of the grip-portions 44 in combination with the outer cross-section of the base 43 allows atachment of the appliance 41 to the casing 1, twisted through 180°.

In the region of the open end of the chamber 28 the casing 1 at the main sides 7 and 9 as well as the narrow side 25 is cut away in the shape of triangles as illustrated in FIG. 3. In the completed stage of the unit the corner missing in this way is completed by the base 46 of a toothbrush which is represented in FIGS. 16 and 17; FIGS. 17*d–f* illustrate the shape of the base part. Into the blind hole 47 drilled in the centre of it—in the assembled state of the individual parts represented in FIGS. 16 and 17—a tube 48 is inserted, that is, by its bottom end in FIG. 16*a*, so that the slot which does not pass through at the top end is also closed at that point. The brush part of the toothbrush is designated as a whole by 51; the base 50 of it, which is circular to correspond with the inside of the tube 48, has been inserted beforehand into the tube so that the holder 52 of a grip-plate 53 can slide in the slot 49. For the rest the brush part 51 consists of a stem 54 with the brush carrier 55 and the bristles 56.

As the cross-section from FIG. 4 shows, the chamber 27 is sub-divided again by a partition 57 running in parallel with the main sides 7, 9, so that a further chamber 58 is formed in which the nail file represented in FIG. 18 may be inserted in such a way that the portion 59 of its handle part 60 grips in the cutout 61 in the main side 7, when the nail file is inserted but may easily be removed for use.

FIGS. 19 to 27 show various embodiments of a vanity-case for the care of clothing. As illustrated first of all in FIGS. 19 to 22 (the first embodiment), here too a casing 1 is provided, to the longer narrow side 2 of which an additional fitting 3 is fastened detachably so that a correspondingly larger whole casing results. The clip-on bracket 4 is the same as in the case of the body-care unit described above. In the case of the clothing-care unit the additional fitting 3 (for example) consists of a fluff roller 70 (FIGS. 22*b*+*c*), that is, a roller body supported to be able to turn in the portion of the casing of the additional fitting 3 and the surface of which carries a sticky coating. In FIGS. 22*b*+*c* only partly recognisable arms 73 which correspond essentially with the (nevertheless differently arranged) arms 73*a* in FIG. 25*a*, support the fluff roller 70 at the ends. The joint indicated at 72 between the casing 1 and the portion of casing of the additional fitting 3—which by means of the moulded handle 71 may be detached from the snap-in connection with the casing 1—is to some extent shifted slightly into the portion of casing so that after pulling away the portion of casing of the additional fitting 3 the fluff roller 70 is for the greater part exposed and may be rolled over the garment which is to be cleaned, in which case the casing serves as a handle.

Figures 23A, 23B, 23C, 23D:
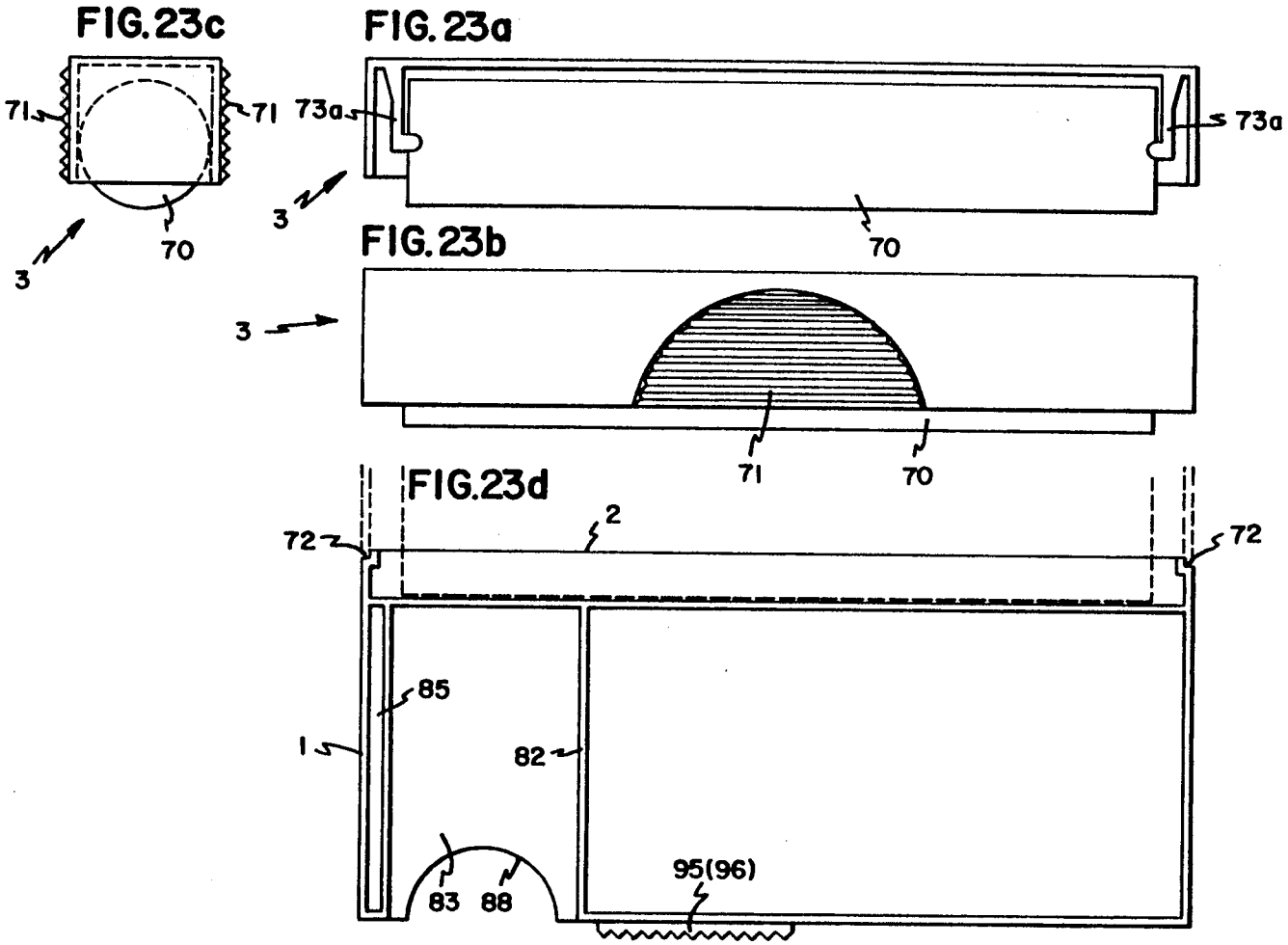

But as FIG. 23 illustrates, the arrangement may be made such that the fluff roller 70 is held by means 73*a* to be able to turn in the portion of casing of the additional fitting 3 and may be pulled away from the casing 1 by the portion of casing; the mounted position is indicated in FIG. 23*d* by dotted lines. FIGS. 23*b* and *c* illustrate that because of the above-mentioned jog in the joint 72 the fluff roller 70 pulled away with the portion of casing of the additional fitting 3 projects by an adequate amount and by means of the handle 71 may be moved over the garment.

In the casing 1 a shoehorn 74, a little flat box 75 for sewing utensils and means of cleaning shoes, for example, in the form of an impregnated sponge are arranged in an insert 76. For this purpose intermediate bottoms 77 and 78 are formed in the casing 1 in parallel with its main sides 7 and 9, which form correspondingly flat chambers 79 (for the shoehorn 74), 80 (for the little box 75 of sewing things) and 81 (in this example without any useful purpose). But the intermediate bottoms 77, 78 do not continue over the whole length of the casing 1, but end at a cross-wall 82 (FIG. 22*a*; dotted in FIG. 20). Beyond the cross-wall 82 is made the chamber 83 for the insert 76; it is bounded on the opposite side by a cross-wall 84 parallel with the cross-wall 82, which runs in parallel with the (upper) short narrow side 29 of the casing 1 at a little distance from it. The flat cross-chamber 85 thereby formed is unused here and merely assists the rigidity of the casing 1.

The insert 76 consists of a rectangular box 86 in the form of a frame, areas of which on opposite sides associated with the main sides 7, 9 are thickened into (ribbed) handles 87, that is, with an approximately semi-circular contour which corresponds with a cutout 88 in the main sides 7, 9 (FIGS. 22*a*+*b*, 21, 22). Towards the outside the insert 76 is closed off by a lid 89 fitting into the longer narrow side wall 25 (FIGS. 21*a*, 22*b*). Into the cavity in the insert 76 may be fitted, for example, a correspondingly shaped (and impregnated) sponge, which corresponding with the length of the chamber 83 projects beyond the insert and is exposed when the insert 76 is pulled out of the casing 1.

The shoehorn 74 consists essentially of an arched plate 90 which is guided to be able to slide in the direction longitudinal to the casing 1 between portions 91 of web (FIG. 22*c*); the portions 91 of web are moulded to the inside of the main side 9 and in the opposite direction onto the intermediate bottom 77. At the side the plate 90 is guided against the longer narrow side wall 25, that is, in the direction to slide it out (arrow 92 in FIG. 23*a*) near the rear end of the plate 90 by means of an extension 93 at the side, which passes through a guide slot 94 in the narrow side 25 and ends in a handle 95 by means of which the plate 90 (shoehorn 74) may be slid out of a correspondingly shaped opening in the (lower) short narrow side (FIG. 21*c*). FIG. 21*a* makes it clear that the slot 94 does not go through as far as the bottom end of the narrow side 25 so that the extension 93 comes to a stop when the plate 90 has been slid out far enough.

In parallel with that the little box 75 adapted in cross-section to the chamber 80 is guided between the intermediate bottoms 77, 78 and by means of the handle 96 and the connecting extension 97 may be slid out of the previously-mentioned short narrow side of the casing 1 (FIG. 21*c*), that is, completely because the slot 98 which guides the side extension 97 continues downwards via the narrow side wall 25 and emerges at the end face of this from the adjoining short narrow side wall (FIGS. 21*a*+*c*). The little box 75 is made thin-walled with a flap lid; this is not shown in detail.

FIGS. 24 to 27 show another embodiment of the clothing-care unit. In that case FIGS. 24 and 25 correspond with FIGS. 19 and 20 of the previously-described embodiment and also FIG. 26 largely corresponds with FIGS. 21 and 22. In the case of this embodiment a comb 130 is provided in addition which essentially fills out to some extent the chamber 81 (FIG. 22*c*) empty in the other example. The comb 130 has a thickened and ribbed handle portion 131 which co-operates with a corresponding cutout 132 in the side wall 7 of the casing 1. The guidance of the comb 130 is effected in addition by cross-walls 78*a* and 78*b* between the outer wall 7 and the intermediate bottom 78.

Figures 26A, 26B, 26C, 26D, 26E:
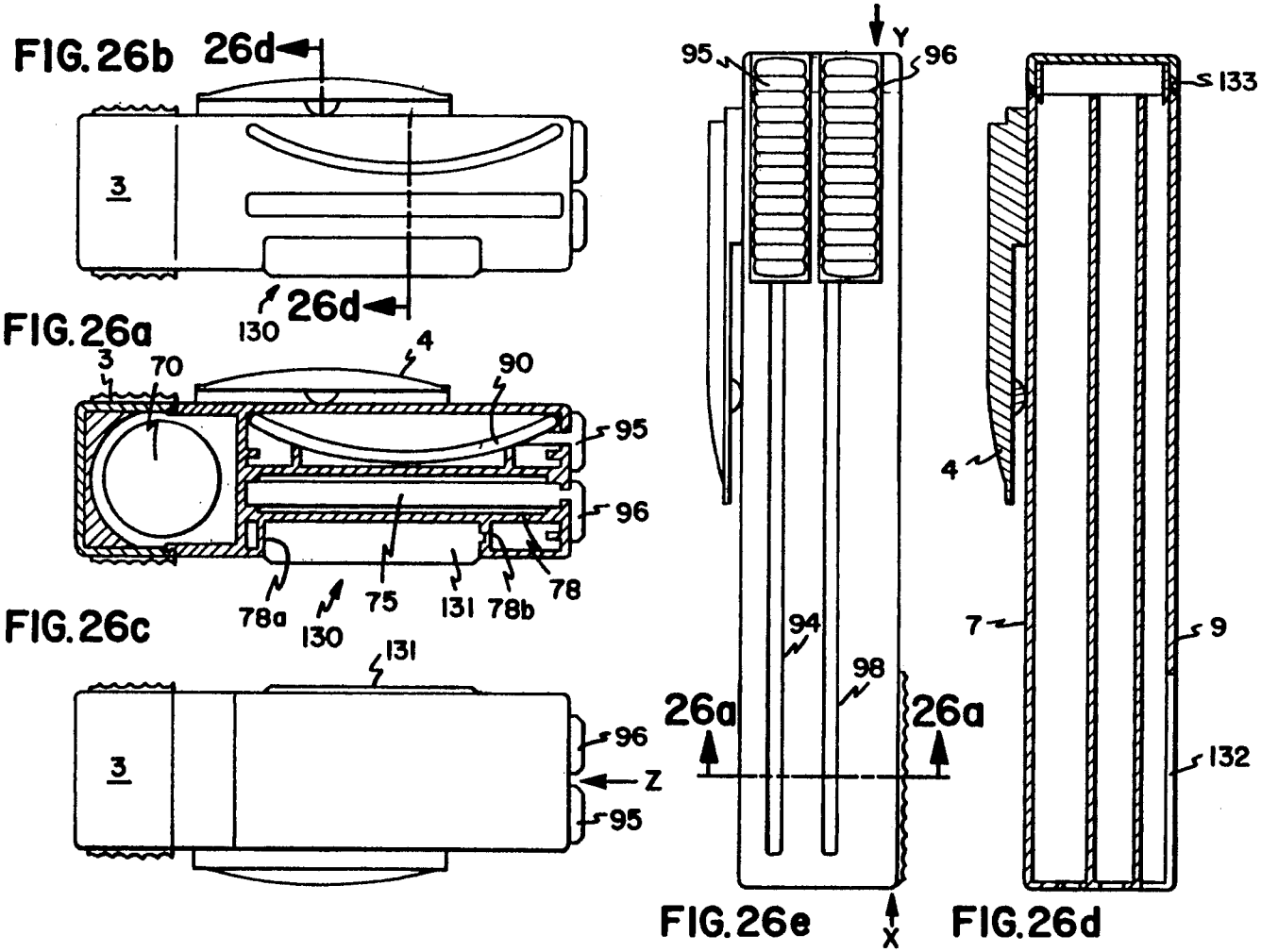

FIG. 26*d* further illustrates (in combination with FIGS. 24 and 25) that opposite the outlet or removal side for the shoehorn, the little sewing box and the comb, an auxiliary cover 133 is provided extending over part of the width of the casing 1, which only serves to simplify the manufacture of the unit (insertion of the shoehorn and the little sewing box as well as connection to their sliding elements).

I claim:

1. A travel case comprising:

a case unit defining an interior space formed by a rear main side (7), a front main side (9) parallel to said rear main side (7) and four narrow sidewalls extending between said rear and said front main side;

said interior space having a plurality of chambers holding a plurality of removable articles, all articles being accessible at a unique location on said sidewalls and along a single axis of the travel case, the parallel construction of said rear main side and said front main side defining a gripping surface which does not interfere with the removal of any of said articles from said travel case, whereby said gripping surface is held in one hand and all of said articles can be removed from said travel case by the other hand without changing the users grasp; and a portion of at least one of said sidewalls being formed integrally with at least one said removable articles, said portion completing a continuous closed outer surface for said sidewalls.

2. A travel case of claim 1, including at least one additional case unit defining an interior space formed by a plurality of side walls and means for detachably retaining said additional case unit to at least one sidewall of said travel case, forming additional chambers to retain additional articles.

3. A travel case of claim 2 where one of said additional case units has an open end and is adapted to snap on to one of said side walls of said travel case, forming a common wall therebetween, said common wall operating to close off said open end of said additional case unit.

4. A travel case of claim 1 wherein said travel case has at least one liquid-tight, openable flap for retaining one of said articles in said chamber.

5. A travel case of claim 1 further including a sliding plate fastened to an article and projecting through a slot in the case, allowing the article to be pushed out of the chamber by applying sliding pressure to said plate.

6. A travel case of claim 1, wherein an article may be slid telescopically out of a chamber in the travel case.

7. A travel case of claim 1 including a clip-on bracket fitted to at least one sidewall of said travel case.

* * * * *